US007311581B2

(12) United States Patent
Hsu

(10) Patent No.: US 7,311,581 B2
(45) Date of Patent: Dec. 25, 2007

(54) INFLATABLE FERRIS WHEEL

(75) Inventor: Sheng-Hung Hsu, Renwu Hsiang (TW)

(73) Assignee: Gemmy Industries Corporation, Coppell, TX (US)

( * ) Notice: Subject to any disclaimer, the term of this patent is extended or adjusted under 35 U.S.C. 154(b) by 171 days.

(21) Appl. No.: 11/237,391

(22) Filed: Sep. 28, 2005

(65) Prior Publication Data

US 2007/0072510 A1 Mar. 29, 2007

(51) Int. Cl.
*A63H 33/30* (2006.01)

(52) U.S. Cl. ..... 446/220; 40/423; 446/236

(58) Field of Classification Search ..... 40/411, 40/414, 421, 423, 430; 446/220, 221, 236; 472/45

See application file for complete search history.

(56) References Cited

U.S. PATENT DOCUMENTS 1,867,996 A * 7/1932 Baer ..... 472/3
2,590,934 A * 4/1952 Catlett ..... 472/3
3,226,113 A * 12/1965 Mercer et al. ..... 472/3

* cited by examiner

*Primary Examiner*—John A. Ricci
(74) *Attorney, Agent, or Firm*—Alan Kamrath; Kamrath & Asssociats PA

(57) ABSTRACT

An inflatable Ferris wheel that can be rotated by a motor has a base having a pedestal chamber connected to two sidewall chambers, and an inflatable wheel having two end-plate chambers connected to a central hub chamber. A major hollow shaft is located through the end-plate chambers of the inflatable wheel to rotatably mount the wheel in the open space defined by the sidewalls of the base. Multiple ornaments are attached to minor hollow shafts and rotatably mounted to the inflatable wheel. A blower-fan mounted on a seat is connected to an intake pipe at one of the sidewall chambers to inflate the Ferris wheel. A motor with an arbor is located inside one of the sidewall chambers and is attached to the major hollow shaft. The motor rotates the inflatable wheel and the ornaments to create a dynamic sight and an exciting atmosphere.

5 Claims, 5 Drawing Sheets

INFLATABLE FERRIS WHEEL

BACKGROUND OF THE INVENTION

1. Field of the Invention

The present invention relates to a Ferris wheel, and particularly relates to an inflatable Ferris wheel that can be rotated by a motor and act as a dynamic decoration at meeting places or events.

2. Description of the Related Art

Large inflatable toys are often arranged at various meeting places or events to create an exciting atmosphere and attract people's attention. These toys are filled with air with an air-charging device, such as a blower fan. Large, tall and colorful inflatable toys always attract the public's attention. However, inflatable toys cannot move, they only stand still, which lacks liveliness and excitement.

Therefore, the invention provides an inflatable Ferris wheel that rotates to mitigate or obviate the aforementioned problems.

SUMMARY OF THE INVENTION

The main objective of the present invention is to provide an inflatable Ferris wheel that can be rotated by a motor, which presents a dynamic sight and creates an exciting atmosphere.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
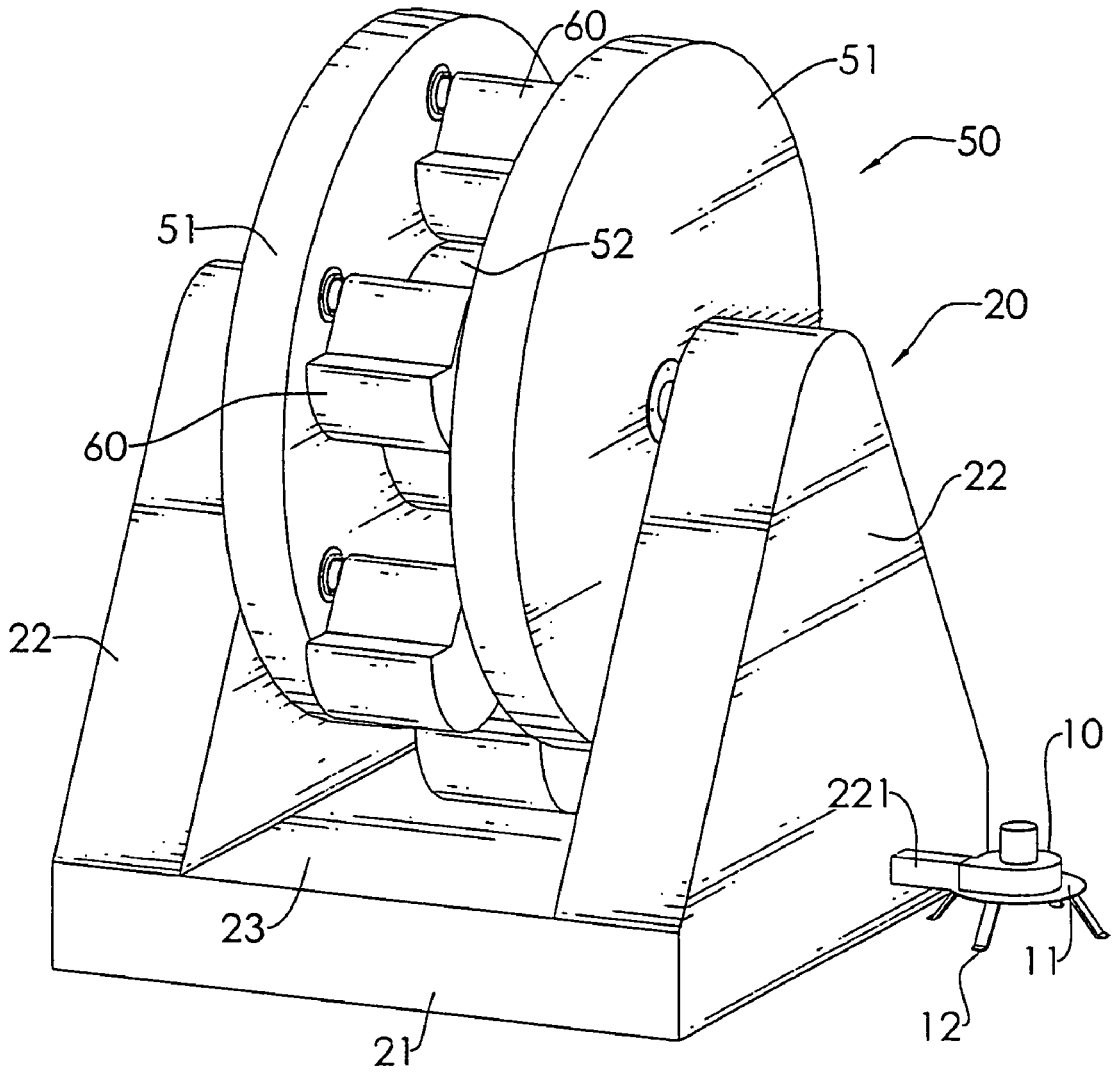
FIG. 1 is a perspective view of the inflatable Ferris wheel in accordance with this invention.

With reference to FIGS. 1-5, an inflatable Ferris wheel has an inflatable base (20) comprising a pedestal chamber (21) and two sidewall chambers (22) that communicate with the pedestal (21), and an open space (23) defined between the two sidewall chambers (22). At a lower part of one of the sidewall chambers (22) an intake pipe (221) is provided, which is connected to a blower fan (10) mounted on a seat (11) supported by multiple legs (12).

The inflatable Ferris wheel also has an inflatable wheel (50) composed of two end-plate chambers (51) mounted on and communicating with a central hub chamber (52). The inflatable wheel (50) has a major hollow shaft (40) located through two holes (53) respectively defined in the center of each end-plate chamber (51). A plurality of first air vents (43) are defined on the surface of the major hollow shaft (40). A motor (30) having an arbor (301) is provided inside a side-wall chamber (22). One end of the arbor (301) is received in a first orifice (42) in one end of the major hollow shaft (40). A second orifice (421) is defined in the other end of the major hollow shaft (40).

Figure 2:
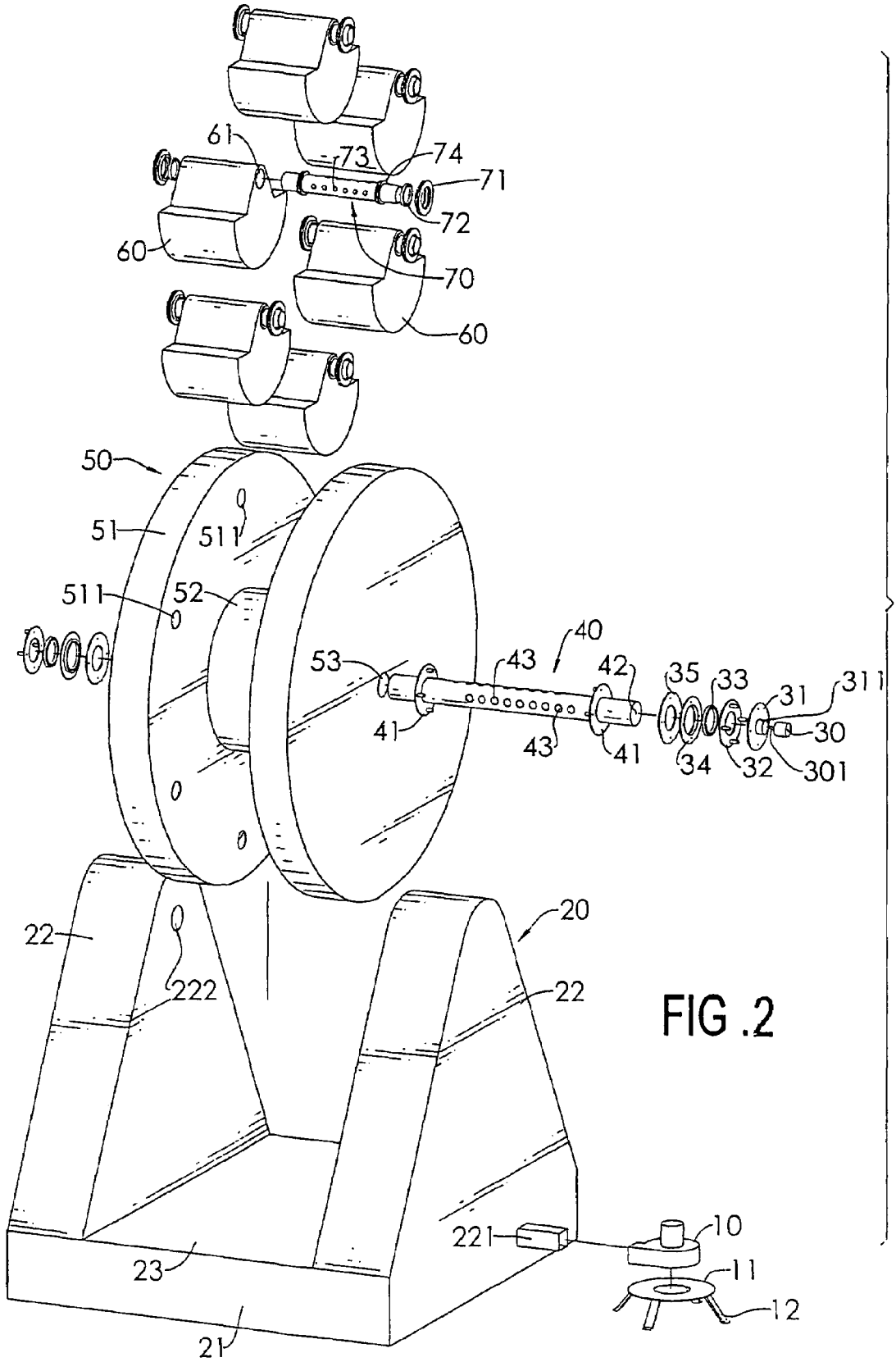
FIG. 2 is an exploded view of the inflatable Ferris wheel in accordance with this invention.
Figure 5:
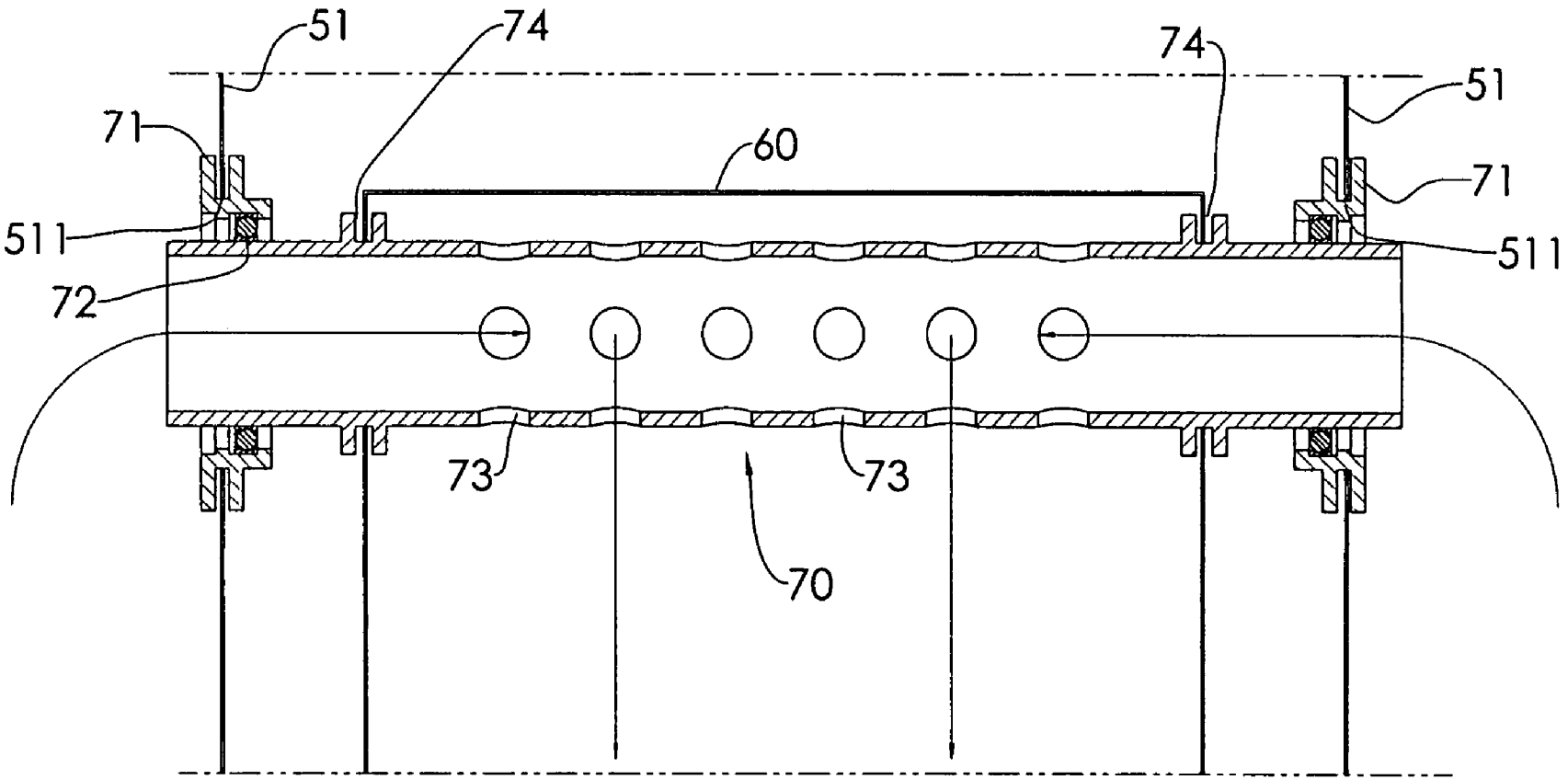
FIG. 5 is a sectional view of a minor hollow shaft in accordance with this invention.

Multiple inflatable ornaments (60) are provided between the two end-plate chambers (51). Each ornament (60) has a minor hollow shaft (70) with two open ends located through a channel (61) defined by holes in each side of the ornament (60). The two ends of the channel (61) are engaged in two slots (74) defined on the minor hollow shaft (70), with the two open ends of the minor hollow shaft (70) extending outside the body of the ornament (60). With reference to FIG. 2 and FIG. 5, multiple apertures (511) are defined in the inside walls of the inflatable wheel (50) around the central hub chamber (52). Multiple second air vents (73) are defined on the surface of the minor hollow shaft (70). Two first bearings (72) are respectively provided in two bearing washers (71), which are received in the apertures (511), whereby the two ends of the minor hollow shaft (70) are rotatably mounted in the two first bearings (72).

The inflatable wheel (50) has a major hollow shaft (40) located through two holes (53) respectively defined in the center of each end-plate chamber (51). Two first female washers (41) are attached concentrically to the major hollow shaft (40) near each end of the major hollow shaft (40), respectively. The two first female washers (41) are positioned inside the end-plate chamber (51) walls. Two first male washers (35) are respectively mounted on the outside of the end-plate chamber (51) walls to mate with the female washers, whereby the inflatable wheel (50) is securely fastened to the major hollow shaft (40).

Figure 3:
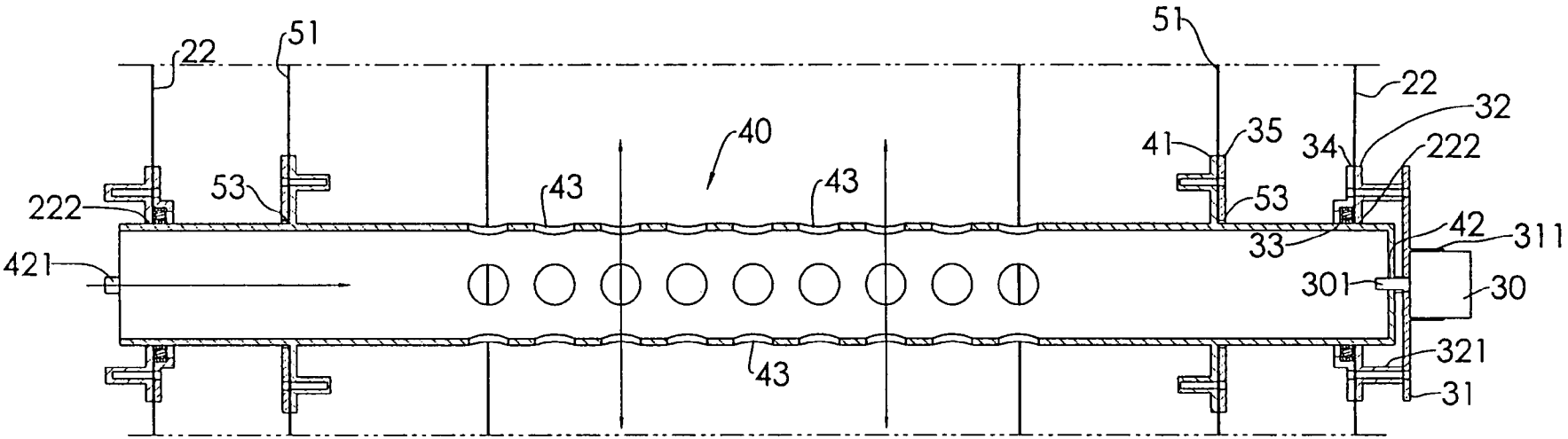
FIG. 3 is a sectional view of a major hollow shaft in accordance with this invention.

With reference to FIGS. 2 and 3, two mounting holes (222) are defined in the inner walls of the two sidewall chambers (20). Two second female washers (32), each with protruding rods (321), are respectively mounted inside the sidewall chamber (20) wall at the mounting holes (222). Two second male washers (34) are respectively mounted outside of the sidewall chamber (20) walls to mate with the two second female washers (32). Two second bearings (33) are respectively mounted between the second female washer (32) and the second male washer (34). The two ends of the major hollow shaft (40) are rotatably secured in the two second bearings (33).

A mounting plate (31) is fastened by screws to the protruding rods (321) of one of second female washers (32), and a frame (311) is provided to secure a motor (30). The motor (30) has an arbor (301) protruding through the mounting plate (31) and fastened in the first orifice (42).

The entire inflatable wheel (50) is rotatably mounted in the open space (23) defined by the two sidewall chambers (22). The arbor (301) is driven by the motor (30) to rotate the major hollow shaft (40) and the inflatable wheel (50).

The base (20) can be rigid in construction, while the inflatable wheel (50) and the inflatable ornaments (60) can be sewn to form various shapes.

Figure 4:
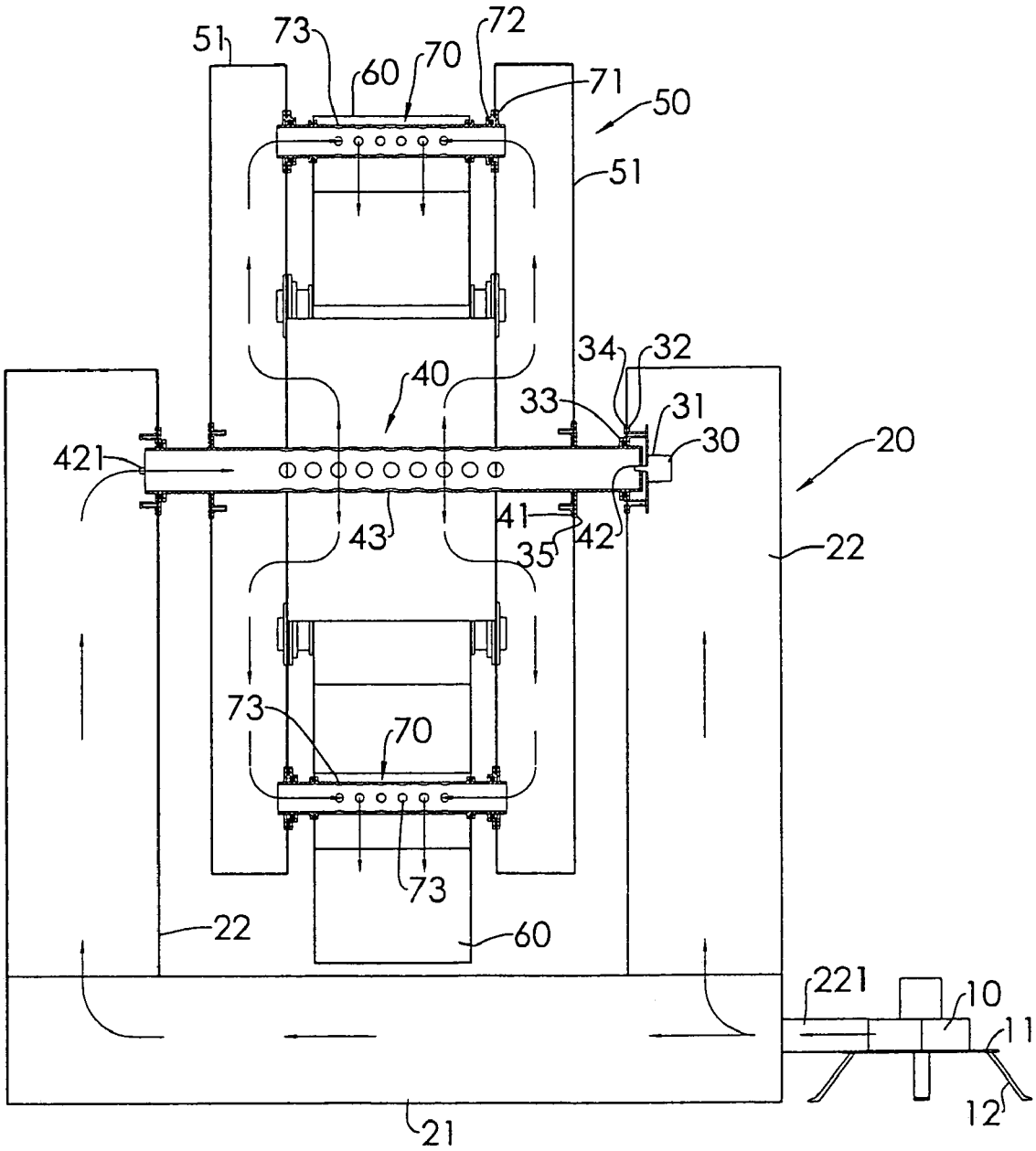
FIG. 4 is a schematic illustration indicating the direction of air flow when the Ferris wheel of this invention is charged.

With reference to FIG. 4, when the Ferris wheel is in operation and the blower fan (10) is activated, the outside air enters the base (20) through the intake pipe (221). The air flows into and inflates the pedestal chamber (21) and the sidewall chambers (22). The air then flows into the major hollow shaft (40) through the second orifice (421), passes through the first air vents (43) to charge the inflatable wheel (50). The air then enters into the minor hollow shafts (70) to charge the inflatable ornaments through the second air vents (73). The motor (30) rotates the major hollow shaft (40), and in turn the inflatable wheel (50) and the inflatable ornaments (60) mounted on the inflatable wheel (50), thereby creating a dynamic sight and an exciting atmosphere.

It is to be understood, however, that even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An inflatable Ferris wheel comprising a base comprising a pedestal chamber, two sidewall chambers that communicate with the pedestal chamber, an open space defined between the two sidewall chambers, and an intake pipe provided at one of the sidewall chambers;

an inflatable wheel rotatably attached to the base and composed of two end-plate chambers, a central hub chamber connecting and communicating with the two end-plate chambers, a major hollow shaft with a plurality of first air vents rotatably mounted between the sidewall chambers, and a first orifice and a second orifice defined at each end of the major hollow shaft, respectively;

a motor provided inside one of the sidewall chambers and having an arbor with one end of the arbor received in the first orifice of the major hollow shaft;

multiple inflatable ornaments provided between the two end-plate chambers, wherein each ornament has a minor hollow shaft with two open ends and multiple second air vents and two slots defined on the surface of the minor hollow shaft;

a seat; and a blower fan connected to the intake pipe provided at one of the side chambers and mounted on the seat.

2. The inflatable Ferris wheel as claimed in claim 1 wherein the seat is supported by multiple legs.

3. The inflatable Ferris wheel as claimed in claim 1 wherein the major hollow shaft is located through two holes respectively defined in centers of the end-plate chambers;

two first female washers are respectively mounted inside of the end-plate chambers and on the major hollow shaft; and two first male washers are respectively mounted outside of the end-plate chambers to mate with the female washers.

4. The inflatable Ferris wheel as claimed in claim 1 wherein two mounting holes are respectively defined in the two sidewall chambers;

two second female washers with protruding rods are respectively mounted inside of the sidewall chambers;

two second male washers are respectively mounted outside of the sidewall chambers;

two second bearings are respectively mounted between the second female washers and the second male washers;

the two ends of the major hollow shaft are rotatably mounted in the two bearings;

a mounting plate is fastened by screws to the rods of one of the second female washers;

a frame is provided to secure a motor; and the motor has an arbor protruding through the mounting plate and fastened in the first orifice.

5. The inflatable Ferris wheel as claimed in claim 4 wherein the minor hollow shaft of each ornament is located through a channel defined in the ornament;

two ends of the channel are engaged in two slots defined on the minor hollow shaft;

multiple apertures are defined in the inflatable wheel around the central hub chamber;

two first bearings are respectively provided in two bearing washers, which are received in the apertures, whereby the two ends of the minor hollow shaft are rotatably mounted in the two first bearings.

* * * * *